US005692232A

United States Patent [19]

Okano et al.

[11] Patent Number: 5,692,232

[45] Date of Patent: Nov. 25, 1997

[54] ELECTROPHOTOGRAPHIC APPARATUS THAT PREVENTS TONER FROM ATTACHING TO A CONTACT MEMBER OF A TRANSFER DEVICE

[75] Inventors: Yoshiaki Okano; Hiroshi Hashizume; Hirotaka Fukuyama; Kouichirou Satou; Tetsuya Nakamura; Satoshi Katagata; Michihisa Iguchi; Seiji Arai; Chinobu Sakai; Takahito Kabai, all of Tokyo, Japan

[73] Assignee: Kabushiki Kaisha Toshiba, Kawasaki, Japan

[21] Appl. No.: 599,101

[22] Filed: Feb. 9, 1996

Related U.S. Application Data

[63] Continuation of Ser. No. 114,240, Aug. 31, 1993, abandoned.

[30] Foreign Application Priority Data

| | | | |
|---|---|---|---|
| Aug. 31, 1992 | [JP] | Japan | 4-232405 |
| Aug. 31, 1992 | [JP] | Japan | 4-232408 |
| Sep. 2, 1992 | [JP] | Japan | 4-234611 |

[51] Int. Cl.[6] ..... G03G 15/08

[52] U.S. Cl. ..... 399/53; 399/50; 399/66; 399/260; 399/313; 399/314

[58] Field of Search ..... 355/271, 273, 355/277, 245, 246, 208, 219, 274, 261, 259; 399/260, 53, 50, 66, 168, 297, 310, 313, 314, 284, 283, 273, 272, 281, 167; 118/651

[56] References Cited

U.S. PATENT DOCUMENTS

| | | | |
|---|---|---|---|
| 5,182,604 | 1/1993 | Asai | 355/273 |
| 5,239,345 | 8/1993 | Kikuchi et al. | 355/245 X |
| 5,270,786 | 12/1993 | Kikuchi et al. | 355/261 |
| 5,287,149 | 2/1994 | Hoshika | 355/246 |
| 5,438,395 | 8/1995 | Koga et al. | 355/259 X |

FOREIGN PATENT DOCUMENTS

| | | | |
|---|---|---|---|
| 58-214174 | 12/1983 | Japan . | |
| 1-291273 | 11/1989 | Japan . | |
| 2-308282 | 12/1990 | Japan | 355/274 |
| 5-273820 | 10/1993 | Japan | 355/274 |
| 2204508 | 11/1988 | United Kingdom | 355/274 |

*Primary Examiner*—S. Lee

*Attorney, Agent, or Firm*—Finnegan, Henderson, Farabow, Garrett & Dunner, L.L.P.

[57] ABSTRACT

At start of rotation of a photosensitive drum, rotation of a developing roller caused by a developing/register rollers driver is kept stopped until a time required for a predetermined point on the photosensitive member, which was located at a charging position when charging thereof by a charging device was started, to reach a development position elapses, and thereafter the developing roller is rotated by the developing/register rollers driver. When the predetermined point on the photosensitive member, which was located at the developing position when at least rotation of the photosensitive member was started, passes the transfer position, a roller cleaning voltage having the same polarity as the charge polarity of toner is applied to a transfer roller.

12 Claims, 8 Drawing Sheets

ELECTROPHOTOGRAPHIC APPARATUS THAT PREVENTS TONER FROM ATTACHING TO A CONTACT MEMBER OF A TRANSFER DEVICE

This application is a continuation, of application Ser. No. 08/114,240, filed Aug. 31, 1993, now abandoned.

BACKGROUND OF THE INVENTION

1. Field of the Invention

The present invention relates to an electrophotographic apparatus for printing an image in accordance with an electrophotographic process.

2. Description of the Related Art

In an electrophotographic apparatus, an electrostatic latent image is formed on the surface (photosensitive surface) of a photosensitive drum by charging the photosensitive surface of the photosensitive drum to a predetermined potential (e.g., −600 V) by a charging device and exposing the photosensitive surface of the photosensitive drum by an exposure device in accordance with an image to be printed. Toner is attached to the photosensitive surface of the photosensitive drum by a developing device in accordance with the formed electrostatic latent image, thereby developing the image.

In the developing device, the toner is carried by a developing roller and conveyed to be brought into contact with the surface of the photosensitive drum. While the toner carried by the developing roller is conveyed, it is regulated to a thin layer by a developing blade arranged to contact the developing roller, and is charged by friction to have the same polarity as the charge potential of the photosensitive drum (i.e., negative polarity). A low-voltage developing bias (e.g., −200 V) having the same polarity as that of the charge potential of the photosensitive drum is applied to the developing roller to cause the toner to selectively attach to the photosensitive drum by the electric field produced in accordance with the electrostatic latent image, the developing bias, and the charges of the toner. More specifically, since a non-exposed portion on the photosensitive drum has a higher potential than that of the toner, the toner does not attach to it. Since an exposed and discharged portion on the photosensitive drum has a lower potential than that of the toner, the toner attaches to it. In this manner, a toner image corresponding to the electrostatic latent image is formed on the surface of the photosensitive drum. This toner image is transferred to a printing sheet by a transfer device.

In this electrophotographic apparatus, while the operation is stopped, the surface potential of the photosensitive drum is not stable. When the potential of the photosensitive drum is not stable like this, at the start of printing, as the photosensitive drum passes a position (developing position) where development is performed by the developing device, the toner undesirably attaches to the photosensitive drum having a low potential.

Therefore, charging by the charging device is started simultaneously when rotation of the photosensitive drum is started, thereby minimizing the non-stable surface potential range of the photosensitive drum to prevent the toner from undesirably attaching to the photosensitive drum.

However, a region of the surface of the photosensitive drum located between a position (charging position) where charging is performed by the charging device and the developing position when the photosensitive drum is not rotated reaches the developing position before it is charged when the photosensitive drum is rotated, and the toner cannot be prevented from attaching to this region. When the toner attaches to the photosensitive drum in this manner, if the transfer device is of a contact type using a contact member, e.g., a roller or a brush, the toner attaching to the photosensitive drum undesirably attaches to the contact member of the transfer device.

Sometimes a printing sheet jams on the convey path of the printing sheet. Hence, in the conventional electrophotographic apparatus, occurrence of a Jam is monitored, and when a jam occurs, the printing operation is stopped.

For example, a jam is detected in the following manner. A printing sheet sensor is provided midway along the convey path of the printing sheet and between a thermal fixing device and an sheet outlet. When the sensor is OFF for a predetermined time or more after the register sensor is turned on, a jam is detected. Hence, occurrence of a jam cannot be recognized during a time period after the printing sheet sensor is turned on and until the predetermined time elapses, and the apparatus undesirably continues operation even after a jam occurs. In this manner, toner attaches to a photosensitive drum after a jam occurs and before the apparatus stops its operation. If the apparatus is of a contact type using a contact member, e.g., a roller or a brush, the toner attaching to the photosensitive drum as described above undesirably attaches to the contact member of the transfer device until the apparatus stops or resumes its operation.

When the toner is replenished or the developing device (integrally formed in a process unit together with, e.g., the photosensitive drum and the charging device) is replaced, the amount of toner reserved in the developing device is large immediately after replenishment or replacement. The toner can easily pass between the developing roller and the developing blade without friction due to the pressure of the large amount of toner. Thus, the toner which is not sufficiently charged contacts the photosensitive drum. Since development is performed by the function of the electric field, as described above, if an amount of charge of the toner has not reached a rated value, the operation of the apparatus is not correctly performed. Even if the photosensitive drum is uniformly charged, the toner undesirably attaches to the photosensitive drum, and then attaches to the contact member of the transfer device.

When the toner attaches to the contact member of the transfer device, in this manner, the toner soils the rear surface of the printing sheet in subsequent printing, or the transfer efficiency is decreased to cause transfer failure.

SUMMARY OF THE INVENTION

It is a first object of the present invention to provide an electrophotographic apparatus which prevents toner attaching to the contact member of a transfer device of a contact type from soiling the rear surface of a printing sheet when the printing operation is stopped.

It is a second object of the present invention to provide an electrophotographic apparatus which prevents toner attaching to the contact member of a transfer device of a contact type from soiling the rear surface of a printing sheet when the printing sheet is jammed.

It is a third object of the present invention to provide an electrophotographic apparatus which prevents toner attaching to the contact member of a transfer device of a contact type from soiling the rear surface of a printing sheet when the toner is replenished or the developing device is replaced.

It is a fourth object of the present invention to provide an electrophotographic apparatus which prevents toner attaching to the contact member of a transfer device of a contact type from decreasing a transfer efficiency when the printing operation is stopped.

It is a fifth object of the present invention to provide an electrophotographic apparatus which prevents toner attaching to the contact member of a transfer device of a contact type from decreasing a transfer efficiency when the printing sheet is jammed.

It is a sixth object of the present invention to provide an electrophotographic apparatus which prevents toner attaching to the contact member of a transfer device of a contact type from decreasing a transfer efficiency when the toner is replenished or the developing device is replaced.

According to the present invention, there is provided an electrophotographic apparatus comprising charging means and developing means which are respectively arranged at a predetermined charging position and a predetermined developing position along a surface of a photosensitive member, the photosensitive member having a predetermined point which is located at the charging position when charging of the photosensitive member by the charging means starts, the developing means including toner carrier means and carrier rotating means for rotating the toner carrier means, the apparatus further comprising:

development control means for keeping rotation of the toner carrier means by the carrier rotating means stopped from start of rotation of the photosensitive member until the predetermined point of the photosensitive member reaches the development position.

According to the present invention, there is provided another electrophotographic apparatus comprising charging means which is arranged at a predetermined charging position along a surface of a photosensitive member and developing means which is arranged at a predetermined developing position along the surface of the photosensitive member, the developing means including toner carrier means and carrier rotating means for rotating the toner carrier means, the toner being charged to have a predetermined polarity by rotation of the toner carrier means, the photosensitive member having a predetermined point which is located at the charging position when charging of the photosensitive member by the charging means starts, the apparatus further comprising:

first power supply means for generating a voltage having an opposite polarity to the predetermined polarity;

a contact member for applying the voltage generated by the first power supply means to a printing sheet disposed at the photosensitive member;

second power supply means for generating a voltage having the predetermined polarity;

switching means having at least a first state, in which the voltage generated by the first power supply means is applied to the contact member, and a second state, in which the voltage generated by the second power supply means is applied to the contact member; and control means for setting the switching means to the second state when the predetermined point of the photosensitive member passes the transfer position.

According to the present invention, there is provided a further electrophotographic apparatus comprising:

developing means, arranged at a predetermined developing position, for forming a toner image on a photosensitive member;

transfer means, arranged at a predetermined transfer position, for transferring, to a printing sheet, the toner image formed on the photosensitive member; and aligning means for adjusting a posture of the printing sheet to be conveyed to the transfer position to a predetermined state, the aligning means being arranged at such a predetermined position that a distance of a convey path of the printing sheet from the aligning means to the transfer position is longer than a distance of a moving track of a surface of the photosensitive member from the developing position to the transfer position.

According to the present invention, there is provided a still another electrophotographic apparatus which is shifted to a predetermined standby mode from a normal mode if a printing instruction is not received for a predetermined period of time, the apparatus comprising:

developing means, arranged at a predetermined developing position, for forming a toner image on a photosensitive member which is charged to have a predetermined polarity;

transfer means for transferring the toner image formed on the photosensitive member to a printing sheet, the transfer means including a contact member arranged to contact a printing sheet arranged to contact the photosensitive member, first voltage generating means for generating a first voltage having an opposite polarity to the predetermined polarity, second voltage generating means for generating a predetermined second voltage having the predetermined polarity, and switching means having at least a first state, in which the first voltage is applied to the contact member, and a second state, in which the second voltage is applied to the transfer roller; and control means for setting the switching means to the first state when the apparatus is shifted from the standby mode to the normal mode.

According to the present invention, there is provided a still further electrophotographic apparatus having an openable/closable apparatus cover, the apparatus comprising:

developing means for forming a toner image on a surface of a photosensitive member which is charged to have a predetermined polarity, the developing means including toner carrier means, carrier rotating means for rotating the toner carrier means, developing bias power supply means for generating a developing bias to be applied to the toner carrier means, and developing switching means for turning on/off application of the developing bias to the toner carrier means;

transfer means for transferring the toner image formed on the surface of the photosensitive member to a printing sheet, the transfer means including a contact member arranged to contact a printing sheet arranged to contact the photosensitive member, first voltage generating means for generating a first voltage having an opposite polarity to the predetermined polarity, second voltage generating means for generating a second voltage having the predetermined polarity, and switching means having at least a first state, in which the first voltage is applied to the contact member, and a second state, in which the second voltage is applied to the contact member;

detecting means for detecting that the apparatus cover is closed from an open state; and control means for setting, when the detecting means detects that the apparatus cover is closed from the open state, the switching means to the first and second states at least once in a state wherein the photosensitive member is charged, the developing switching means is turned on to apply the developing bias to the toner carrier means, and rotation of the toner carrier means by the carrier rotating means is stopped.

According to the present invention, there is provided a still another electrophotographic apparatus having a low-power mode in which power supplies thereof, excluding predetermined ones thereof, are kept off, comprising:

developing means for forming a toner image on a photosensitive member, the developing means including toner carrier means and carrier rotating means for rotating the toner carrier means; and control means for causing the carrier rotating means to rotate the toner carrier means by a predetermined amount before performing printing in the low-power mode.

According to the present invention, there is provided a still further electrophotographic apparatus having a low-power mode in which power supplies thereof, excluding predetermined ones thereof, are kept off, comprising:

developing means for forming a toner image on a photosensitive member, the developing means including toner carrier means and carrier rotating means for rotating the toner carrier means; and control means for causing the carrier rotating means to rotate the toner carrier by a predetermined amount immediately after the low-power mode is canceled.

According to the present invention, there is provided a still another electrophotographic apparatus comprising:

developing means for forming a toner image on a photosensitive member, the developing means including toner carrier means and carrier rotating means for rotating the toner carrier means;

measuring means for measuring a time in which rotation of the toner carrier means is stopped; and control means, responsive to the measuring means, for, when the time exceeds a predetermined time, causing the carrier rotating means to rotate the toner carrier means by a predetermined amount before printing operation is started.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of an electrophotographic device according to the present invention will now be described with reference to the accompanying drawings. Hereinafter, a facsimile apparatus is explained as an example of the electrophotographic device.

Figure 1:
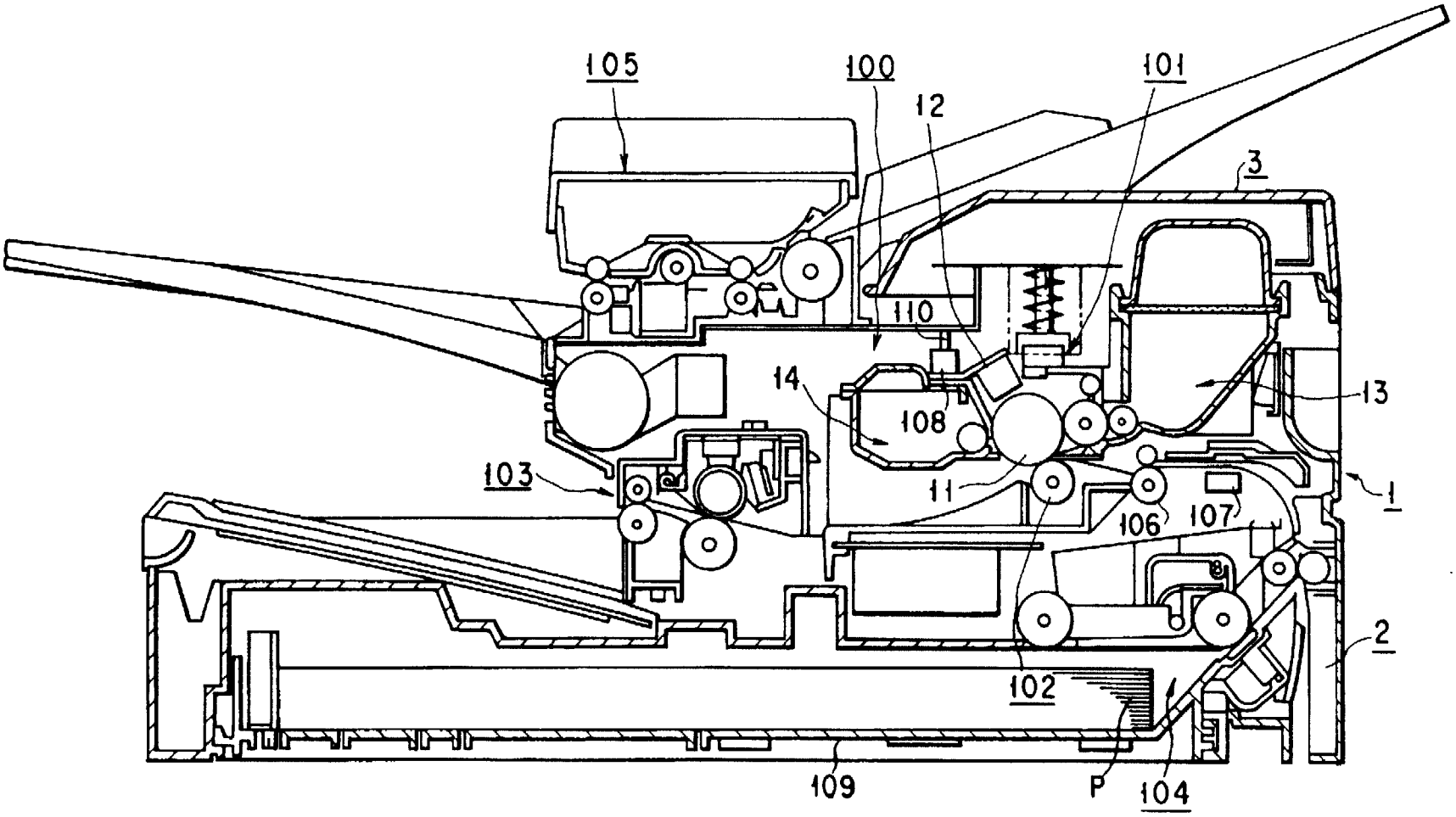
FIG. 1 is a sectional view showing the overall arrangement of a facsimile apparatus incorporating an embodiment of an electrophotographic apparatus according to the present invention.
Figure 2:
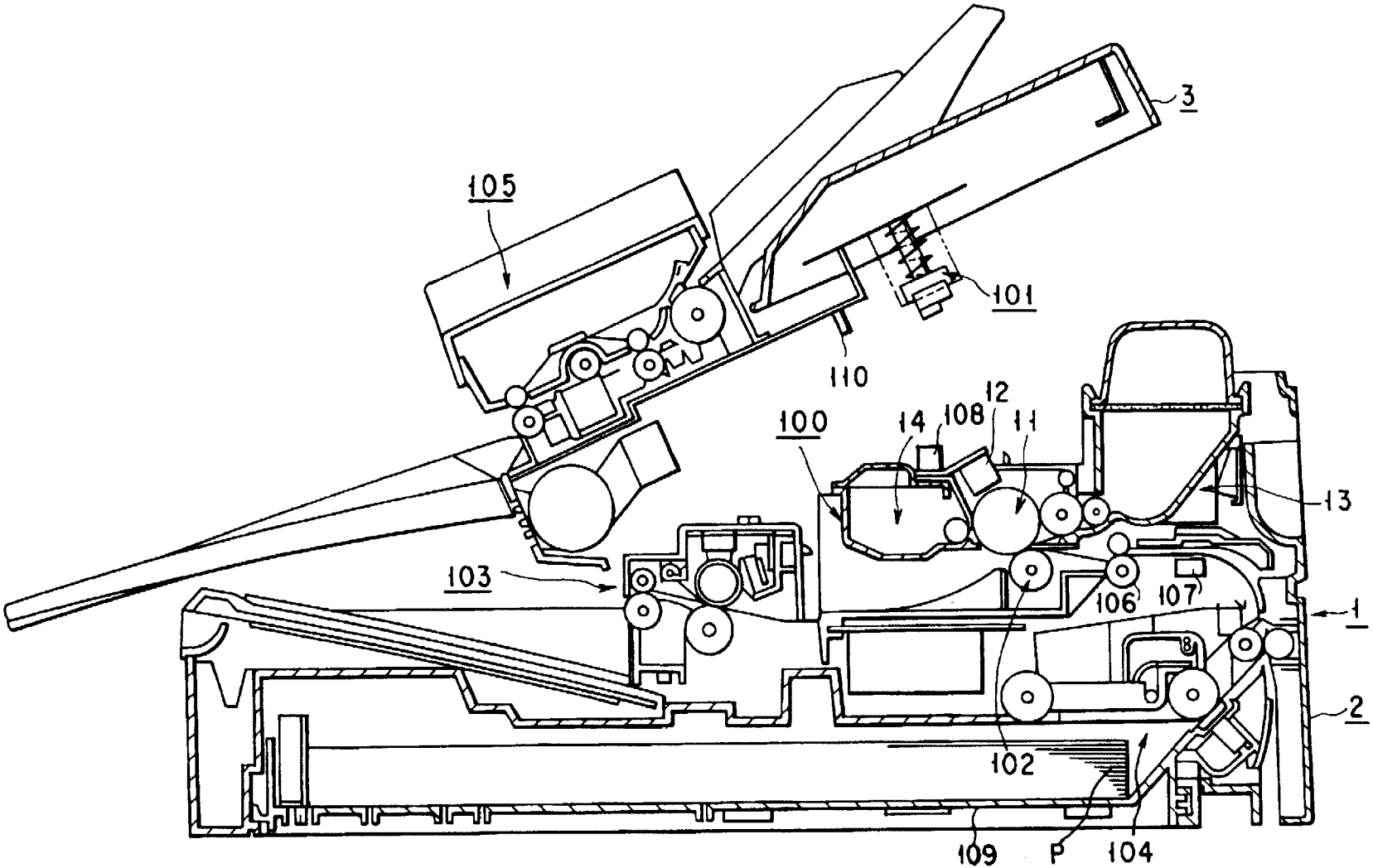
FIG. 2 is a sectional view showing a state wherein the upper body of the facsimile apparatus shown in FIG. 1 is flipped upward.

FIG. 1 is a cross section, showing the overall arrangement of a facsimile apparatus according to the embodiment of an electrophotographic device. A main body 1 is divided into a lower body 2 having an upper opening, and an upper body 3 having a lower opening. The upper body 3 is mounted on the lower body 2 to be vertically pivotal about a shaft (not shown) and opens/closes the upper surface portion of the lower body 2, as shown in FIG. 2. The upper body 3 serves also as an apparatus cover to be capable of opening/closing the apparatus, thereby allowing maintenance of the interior of the apparatus.

A process unit 100, a transfer device 102, a fixing device 103, a paper feed mechanism section or a paper feed device 104, register rollers 106, a registration sensor 107, and a cover open/close sensor 108 are provided in the lower body 2. An exposure device 101 and a communication device 105 are provided in the upper body 3.

The process unit 100 is an integral structure of a photosensitive drum 11, a charging device 12, a developing device 13, and a cleaning device 14, and forms a toner image on the photosensitive drum 11 together with the exposure device 101 in accordance with the so-called Carlson process.

The exposure device 101 includes an LED array (not shown), obtained by arranging a plurality of LEDs in series in an elongated exposure device body 45, and a rod lens array (not shown). The exposure device 101 guides light, emitted by the LED array in accordance with an image signal, to the photosensitive surface of the photosensitive drum 11 through the rod lens array.

The transfer device 102 transfers a toner image formed on the photosensitive drum 11 onto, of printing sheets P stored in a printing sheet tray 109, one fed by the paper feed mechanism section 104.

The fixing device 103 fixes the toner image transferred to the printing sheet.

The communication device 105 optically reads an original to be transmitted and performs photoelectric conversion to generate an image signal. The communication device 105 is connected to a communication line (not shown).

A pair of register rollers 106 correct (align) any skew of the printing sheet P conveyed by the paper feed mechanism section 104 and convey the printing sheet P to a position (transfer position) between the photosensitive drum 11 and the transfer device 102.

The registration sensor 107 comprises, e.g., a microswitch, and is provided to face a printing sheet convey path between the paper feed mechanism section 104 and the register rollers 106, to detect the presence/absence of a printing sheet P on the printing sheet convey path.

The cover open/close sensor 108 is a switch which is turned on/off by a projection 110 formed on the upper body 3, and detects whether or not the upper body 3 closes the lower body 2.

Figure 3:
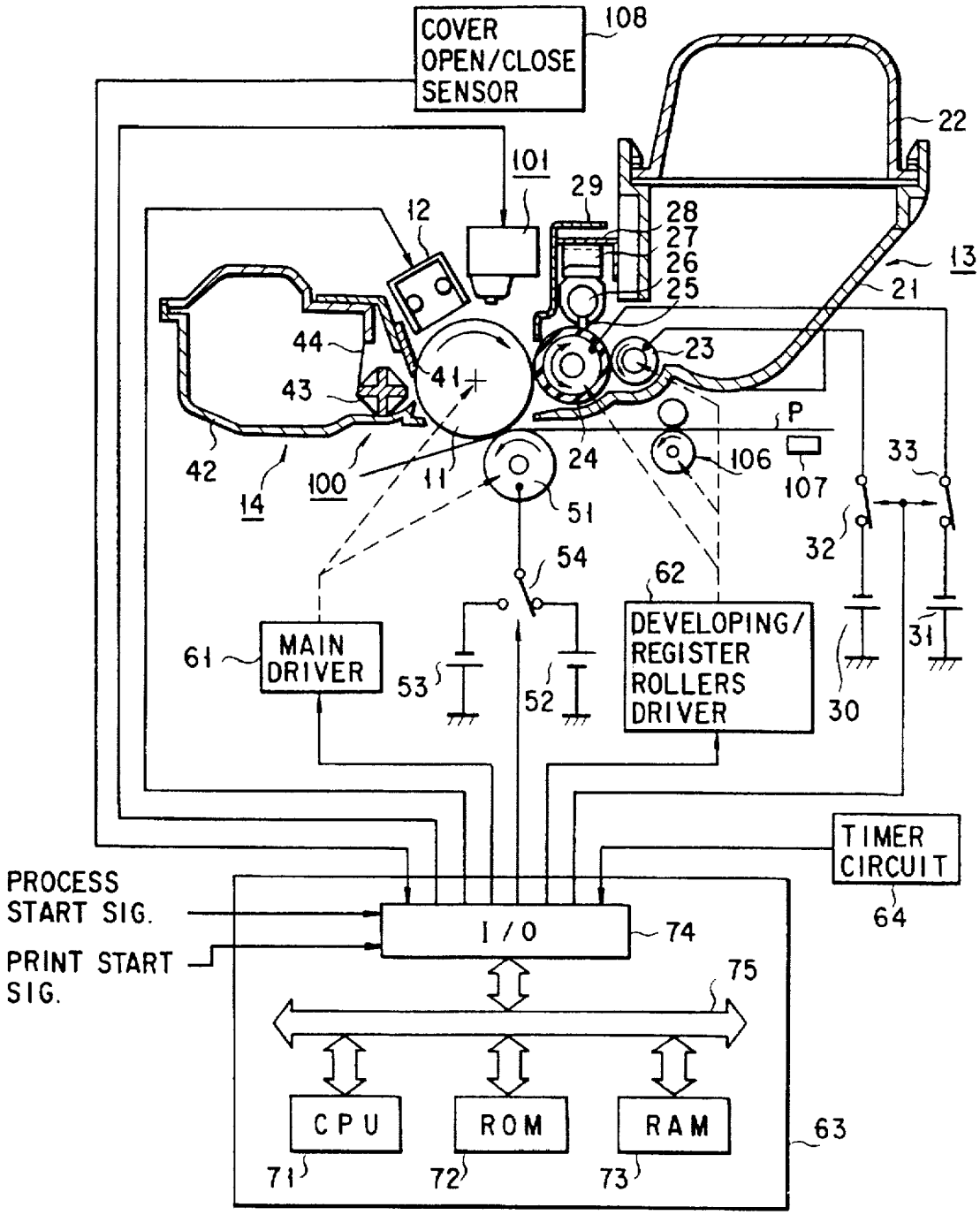
FIG. 3 is a diagram showing the arrangement of a process unit, an exposure device, and a developing device, and the function block arrangement of an electric system associated with them.

FIG. 3 is a diagram showing the arrangement of the process unit 100, the exposure device 101, and the developing device 102, and the function block arrangement of an electric system associated with them. Note that the same reference numerals are used to denote the same portions as in FIG. 1.

In the process unit 100, the charging device 12, the developing device 13, and the cleaning device 14 are arranged around the photosensitive drum 11. The photosensitive drum 11, the charging device 12, the developing device 13, and the cleaning device 14 are integrated as they are supported by unit plates (not shown) located on the right and left sides of the process unit 100.

The photosensitive drum 11 is obtained by forming a photosensitive layer made of a photosensitive conductor material on the outer surface of a conductor, e.g., aluminum. The photosensitive drum 11 is a cylinder having a length larger than the maximum width of the printing sheet on which an image is to be formed, and is supported by the unit plates.

The charging device 12 uses, e.g., a Scorotron charging device having a known arrangement, and uniformly charges the surface of the photosensitive drum 11 to a predetermined potential.

The developing device 13 comprises a toner hopper 21, a toner pack 22, a feed roller 23, a developing roller 24, a developing blade 25, a support rod 26, a leaf spring or spring member 27, a support 28, a reinforcing plate 29, a feed bias power supply 30, a developing bias power supply 31, and switches 32 and 33.

The toner hopper 21 is a hollow container whose side surface and an upper surface are partially open, and stores toner (not shown) therein. The toner pack 22 is mounted on the upper open portion of the toner hopper 21. The toner pack 22 is a container having an open surface. The toner pack 22 is filled with toner, and its opening is sealed with a seal sheet (not shown). When the seal sheet is removed while the toner pack 22 is mounted on the toner hopper 21, as shown in FIG. 3, the toner filled in the toner pack 22 can be supplied to the toner hopper 21.

The feed roller 23 is arranged at the side opening portion of the toner hopper 21 such that it is partly located in the toner hopper 21. The feed roller 23 contacts the developing roller 24 and carries the toner stored in the toner hopper 21. When the feed roller 23 is rotated, it conveys the toner to the developing roller 24. The developing roller 24 contacts the photosensitive drum 11 and carries the toner supplied from the toner hopper 21. When the developing roller 24 is rotated, it conveys the toner and brings it into contact with the surface of the photosensitive drum 11.

The developing blade 25 is made of a silicone resin, urethane, or the like, as shown in FIG. 3. The developing blade 25 maintains an amount of the toner (a thickness of the toner layer) carried and conveyed by the developing roller 24 and charges the toner by friction. The developing blade 25 is provided to the columnar support rod 26 and contacts the developing roller 24. The support rod 26 is urged toward the developing roller 24 by the leaf spring 27, fixed to the support 28, with a predetermined force (e.g., about 50 g/cm$^2$ to 100 g/cm$^2$). Thus, the developing blade 25 is urged against the developing roller 24 with this force. The support 28 is fixed to the side wall of the toner hopper 21.

The reinforcing plate 29 is fixed to the support 28 and the unit plates (not shown) of the process unit 100 to increase the rigidity of the process unit 100 and to prevent the toner carried by the developing roller 24 from scattering.

The feed bias power supply 30 generates a feed bias having a predetermined voltage (e.g., −300 V). The feed bias power supply 30 is electrically connected to the feed roller 23 through the switch 32. The developing bias power supply 31 generates a low-voltage (e.g., −200 V) developing bias having the same polarity as that of the charge potential of the photosensitive drum 11. The developing bias power supply 31 is electrically connected to the developing roller 24 through the switch 33.

The cleaning device 14 comprises a cleaning blade 41, a waste toner storing tank 42, a convey roller 43, and an one-way valve 44. The cleaning blade 41 scrapes off the toner which remains on the photosensitive drum 11 even after the transfer process by the transfer device 102. The waste toner storing tank 42 stores the waste toner scraped by the cleaning blade 41. The convey roller 43 conveys the waste toner scraped by the cleaning blade 41 to the waste toner storing tank 42. The one-way valve 44 prevents the toner in the waste toner storing tank 42 from flowing back to the photosensitive drum 11.

The transfer device 102 comprises a transfer roller 51, a transfer power supply 52, a roller cleaning power supply 53, and a switch 54.

The transfer roller 51 contacts the photosensitive drum 11. The printing sheet P is inserted between the transfer roller 51 and the photosensitive drum 11.

The transfer power supply 52 applies a predetermined transfer voltage (e.g., +1,350 V) having an opposite polarity to that of the charge potential of the toner to the transfer roller 51. The roller cleaning power supply 53 applies a predetermined roller cleaning voltage having an opposite polarity to that of the transfer voltage (but the same polarity as that of the charge potential of the toner) to the transfer roller 51. One of the voltages generated by the transfer power supply 52 and the roller cleaning power supply 53 are selected by the switch 54 and applied to the transfer roller 51. The switch 54 can be controlled to select neither the transfer power supply 52 nor the roller cleaning power supply 53 but turn off the voltage to be applied to the transfer roller 51.

A value V1 of the roller cleaning voltage generated by the roller cleaning power supply 53 is set to satisfy the following conditions:

$|V1-Vs| \leq$ discharge start voltage where Vs is the surface potential of the photosensitive drum 11.

The discharge start voltage is a potential difference between the transfer roller 51 and the photosensitive drum 11 when discharge starts from the transfer roller 51 to the photosensitive drum 11, and is about, e.g., 500 to 600 V. The surface potential Vs of the photosensitive drum 11 is almost equal to the charge potential (slightly lower than that in fact due to dark current attenuation) and is e.g., −600 V. Hence, if the discharge start voltage is 500 V, the value V1 is lower than −1,100 V and is set to, e.g., −1,000 V.

Therefore, when the roller cleaning voltage is applied to the transfer roller 51, discharge will not occur from the transfer roller 51 to the photosensitive drum 11, and an electric field can be stably formed between the photosensitive drum 11 and the transfer roller 51. Accordingly, the toner can be stably attracted by the photosensitive drum 11 due to the function of the electric field, reliably preventing the toner from attaching to the transfer roller 51.

The value V1 of the roller cleaning voltage and a value V2 of the transfer voltage satisfy a following relation:

$|V1|<|V2|$

As other major elements of the electric system associated with the above arrangement, a main driver 61, a developing/register rollers driver 62, a control circuit 63, and a timer circuit 64 are provided.

The main driver 61 comprises, e.g., a motor and a gear, and rotates the photosensitive drum 11 and the transfer roller 51 in directions indicated by arrows in FIG. 3.

The developing/register rollers driver 62 comprises, e.g., a motor and a gear, and rotates the feed roller 23, the developing roller 24, and the register rollers 106 in directions indicated by arrows in FIG. 3.

The control circuit 63 systematically controls the respective portions of the apparatus and includes a CPU 71, a ROM 72, a RAM 73, an I/O port 74, and a bus 75.

The CPU 71 operates in accordance with an operation program stored in the ROM 72 and systematically controls the respective portions of the apparatus. The ROM 72 stores various types of data for use by the CPU 71 in addition to the operation program for the CPU 71. The RAM 73 temporarily stores data required when the CPU 71 performs various types of processing operations. The I/O port 74 generates and outputs control signals and the like to the respective portions of the apparatus under the control of the CPU 71. Also, the I/O port 74 accepts a process start signal and a print start signal supplied from a facsimile main control circuit (not shown) managing the entire facsimile apparatus, an output signal from the cover open/close sensor 108, and time information output from the timer circuit 64, and supplies them to the CPU 71. The CPU 71, the ROM 72, the RAM 73, and the I/O port 74 are connected to each other through the bus 75.

The timer circuit 64 performs a time counting operation based on a signal oscillated by a reference oscillation source, e.g., a quartz oscillator, and outputs time information.

The operation of the electrophotographic apparatus as part of the facsimile apparatus having the above arrangement will be described in accordance with the control sequence of the CPU 71.

In the standby state, the CPU 71 stops the operation of the main driver 61 (rotation of the photosensitive drum 11 and the transfer roller 51), the charging operation of the charging device 12, the exposing operation of the exposure device 101, and the operation of the developing/register rollers driver 62 (rotation of the feed roller 23, the developing roller 24, and the register rollers 106), and keeps the switches and 54 OFF.

Figure 4:
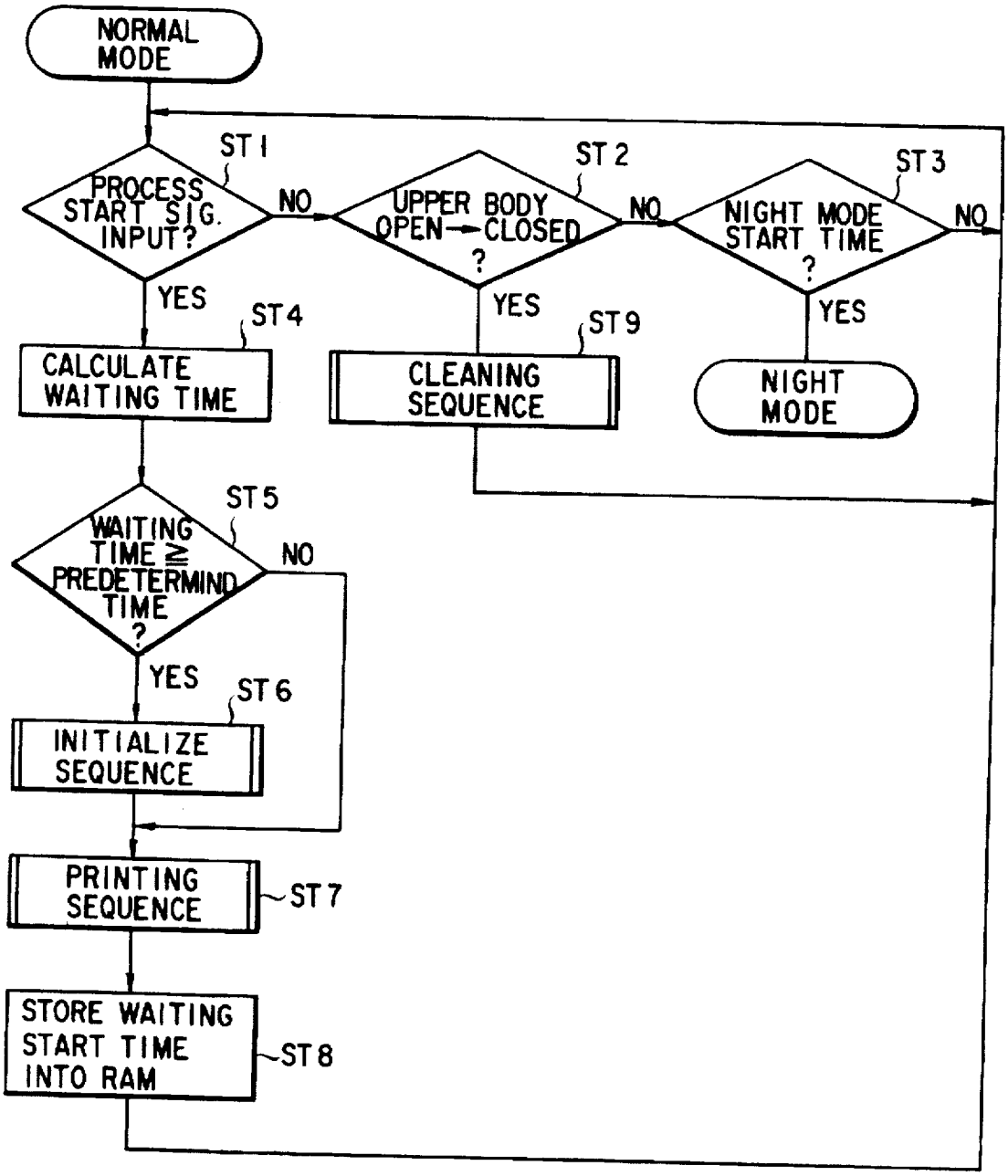
FIG. 4 is a flow chart showing the processing procedure of a CPU in a normal mode.

Also, in the standby state, as shown in FIG. 4, the CPU 71 repeats determination (step ST1) as to whether or not a process start signal is input, determination (step ST2) as to whether or not the upper body 3 is closed from the open state, and determination (ST3) as to whether or not the present time is the start time of the night mode.

In this standby state, if a process start signal is supplied from the facsimile main control circuit and accepted by the I/O port 74, the CPU 71 determines in step ST1 that a process start signal is input, and the flow advances to step ST4. In step ST4, the CPU 71 calculates the waiting time (standby time) of the standby mode. The waiting time is calculated from a time (stored in the RAM 73) when the apparatus is shifted from the operation state to the standby state and the present time indicated by the timer circuit 64. Successively, the CPU 71 determines whether or not the waiting time is equal to a predetermined time (e.g., several hours) or more (step ST5). If NO in step ST5, the CPU 71 executes a printing sequence (step ST7).

The printing sequence will be described in detail with reference to the timing chart of FIG. 5.

Figure 5:
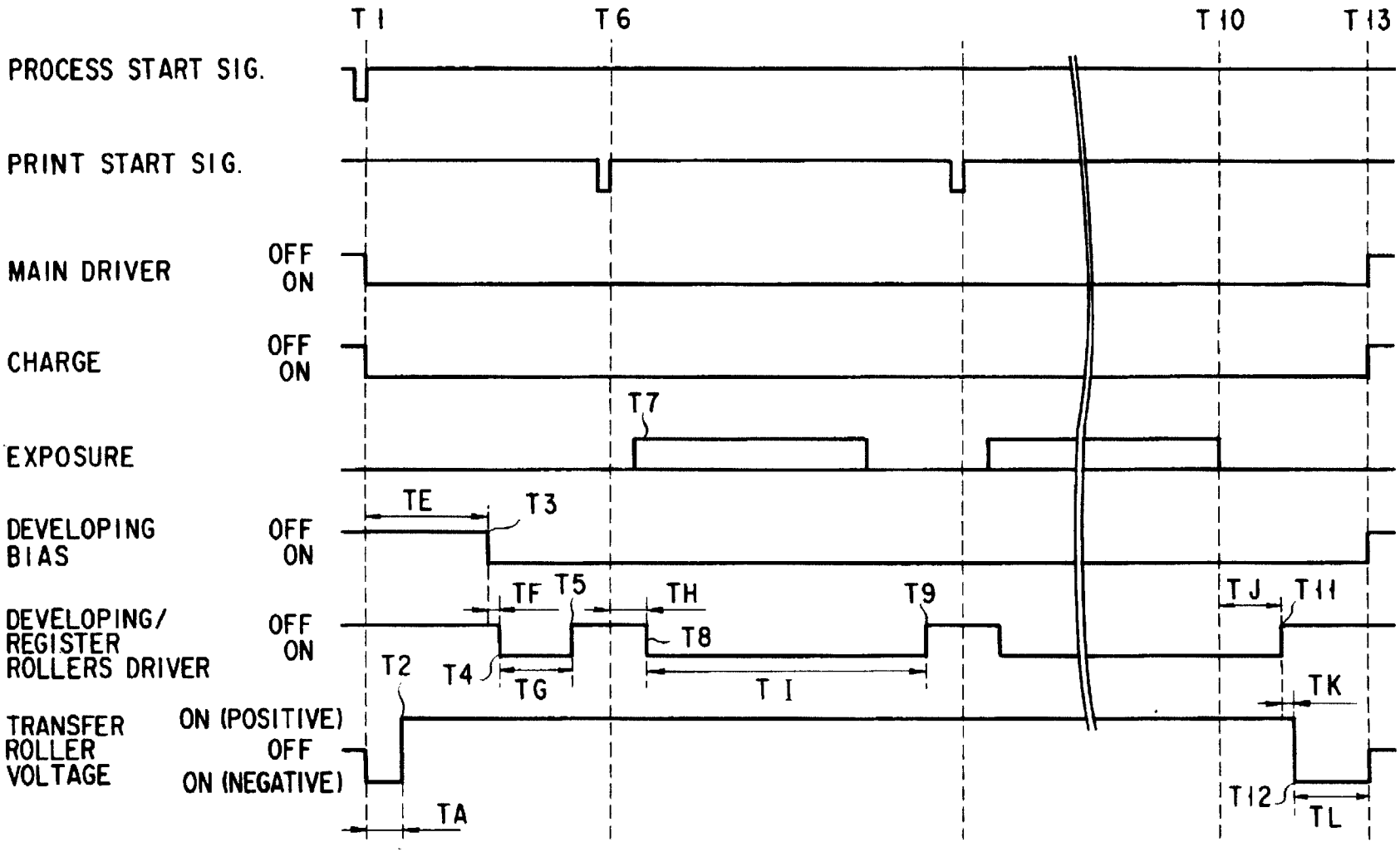
FIG. 5 is a timing chart showing a printing sequence.

The CPU 71 causes the main driver 61 to start its operation in synchronism with the process start signal in order to start rotation of the photosensitive drum 11 and the transfer roller 51, and to start the charging operation of the charging device 12 (a timing T1 in FIG. 5). At the timing T1, the CPU 71 turns on the switch 54 to be connected to the roller cleaning power supply 53. Then, a negative roller cleaning voltage generated by the roller cleaning power supply 53 is applied to the transfer roller 51.

Subsequently, a predetermined period of time TA after the timing T1 (a timing T2 in FIG. 5), the CPU 71 switches the switch 54 to be connected to the transfer power supply 52. The period of time TA is set to be equal to or longer than a period of time required for an arbitrary point on the surface of the photosensitive drum 11 to move from the center (to be referred to as a developing position hereinafter) of the contact position of the photosensitive drum 11 and the developing roller 24 to the center (to be referred to as a transfer position hereinafter) of the contact position of the photosensitive drum 11 and the transfer roller 51.

Figure 6:
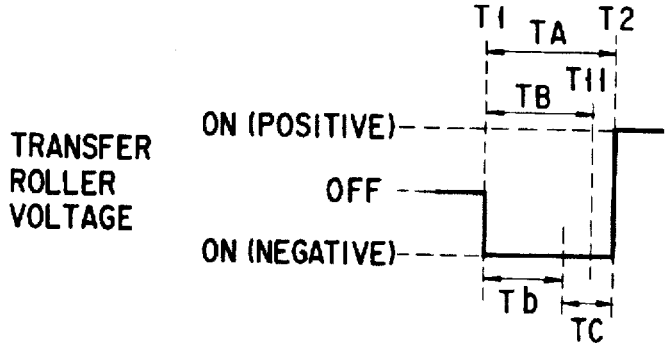
FIG. 6 is a timing chart showing in detail a change in voltage applied to a transfer roller in the printing sequence.

More specifically, as shown in FIG. 6, the time T2 is set to later than the end of a predetermined period of time TC. The period of time TC has a predetermined period and a center which coincides with the end of a period of time TB. The period of time TB is a period of time required for an arbitrary point on the surface of the photosensitive drum 11 to move from the developing position to the transfer position. The period of time TC is set to be equal to or longer than a period of time during which a portion of the photosensitive drum 11, which was in contact with the developing roller 24 while the rotation of the photosensitive drum 11 was stopped, passes the contact portion with the transfer roller 51. Therefore, the start time of the period of time TC is the end of the period of time Tb required for the leading end of the portion of the photosensitive drum 11, which was in contact with the developing roller 24 while the photosensitive drum 11 is stopped, to reach the transfer position.

Assuming that the developing nip width and the transfer nip width are 2 mm, that the process speed (the rotation speed of the outer surface of the photosensitive drum 11) is 32 mm/sec., and that the distance from the developing position to the transfer position is 24 mm, a period of time Tb is about 0.688 sec. and a period of time TC is 0.125 sec. Accordingly, in this case, the period of time TA is 0.813 sec. or more.

While the roller cleaning voltage generated by the roller cleaning power supply 53 is applied to the transfer roller 51 in this manner, the switch 33 for applying the developing bias to the developing roller 24 is kept OFF, and the developing bias generated by the developing bias power supply 31 is not applied to the developing roller 24. The developing/register rollers driver 62 is kept stopped, and the developing roller 24 is not rotating. Therefore, the toner is not supplied to the surface of the photosensitive drum 11, and almost no toner attaches to a portion of the photosensitive drum 11, which was located between the charging position of the charging device 12 and the developing position while rotation of the photosensitive drum 11 was stopped, although the potential of this portion is non-stable. However, regarding the toner which was located at the contact portion between the photosensitive drum 11 and the developing roller 24 while rotation of the photosensitive drum 11 was stopped, it cannot be prevented from attaching to the photosensitive drum 11.

As described above, however, in a period during which the portion of the photosensitive drum 11, which was in contact with the developing roller 24 while rotation of the photosensitive drum 11 was stopped, passes the contact portion with the transfer roller 51, the roller cleaning voltage having the same polarity as that of the toner is supplied to the transfer roller 51. Therefore, the toner attaching to the photosensitive drum 11 is electrically repulsed and does not attach to the transfer roller 51.

It suffices if the period of time during which the roller cleaning voltage generated by the roller cleaning power supply 53 is applied to the transfer roller 51 includes at least the period TC. Therefore, the following modifications are possible.

Figure 7:
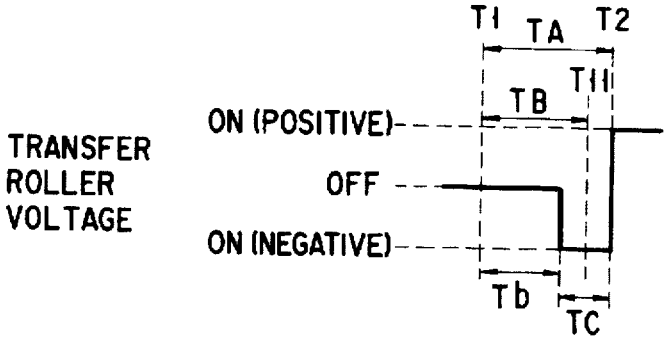
FIG. 7 is a timing chart showing a modification of the printing sequence.
Figure 8:
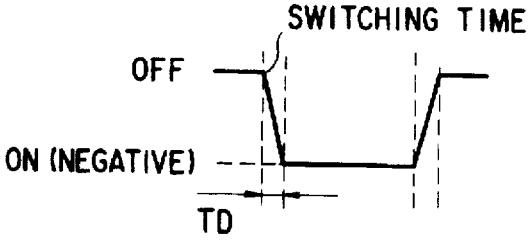
FIG. 8 is a timing chart showing the actual state of change in voltage applied to the transfer roller when a switch is switched.

More specifically, as shown in FIG. 7, the roller cleaning voltage may be applied to the transfer roller 51 only during the period TC. In this case, however, a delay of a period of time TD occurs after the switch 54 is switched to be connected to the roller cleaning power supply 53 and until the potential of the transfer roller 51 reaches a predetermined value, as shown in FIG. 8. Therefore, it is preferable to hasten a timing for switching the switch 54 to the roller cleaning power supply 53 by a time corresponding to the period of time TD by considering this delay TD.

Figure 9:
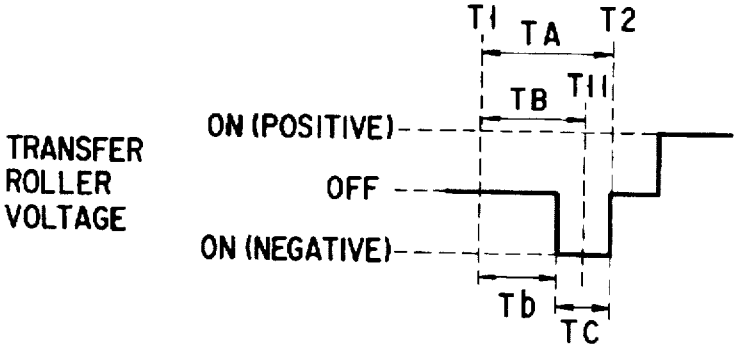
FIG. 9 is a timing chart showing another modification of the printing sequence.
Figure 10:
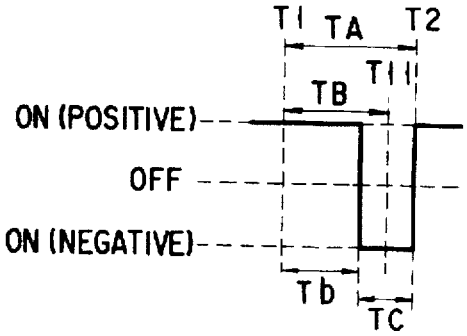
FIG. 10 is a timing showing still another modification of the printing sequence.

In periods before and after the period TD, the voltage to be applied to the transfer roller 51 may be arbitrary. For example, as shown in FIG. 9, after the period TC, voltage supply to the transfer roller 51 may be temporarily turned off, and thereafter the positive transfer voltage generated by the transfer power supply 52 may be applied to the transfer roller 51. Alternatively, as shown in FIG. 10, the positive transfer voltage generated by the transfer power supply 52 may be supplied to the transfer roller 51 before a period TC.

A predetermined period of time TE after the timing T1 (a timing T3 in FIG. 5), the CPU 71 turns on the switches 32 and 33 to start application of the feed bias to the feed roller 23 and of the developing bias to the developing roller 24. The predetermined period of time TE is arbitrarily set, including a minimum of a period of time required for an arbitrary point on the surface of the photosensitive drum 11 to move from the charging position to the developing position. More specifically, the CPU 71 starts application of the feed bias to the feed roller 23 and the developing bias to the developing roller 24 when the region of the surface of the photosensitive drum 11 charged by the charging device 12 reaches the developing position. In this embodiment, the period of time TE is set to a sum (e.g., 4.81 sec) of a period of time required for the photosensitive drum 11 to rotate once and a period of time required for the arbitrary point on the surface of the photosensitive drum 11 to move from the charging position to the developing loping position. In this manner, the period of time TE after start of charging and until start of application of the developing bias to the developing roller 24 is set be longer than the minimum value by a period of time corresponding to one revolution of the photosensitive drum 11, so that the developing device 13 is operated after the entire surface of the photosensitive drum 11 is stably charged.

A short period of time TF (e.g., 0.5 sec) after the timing T3, the CPU 71 starts the operation of the developing/register rollers driver 62 to rotate the feed roller 23, the developing roller 24, and the register rollers 106 (a timing T4 in FIG. 5). Then, the CPU 71 operates the developing/register rollers driver 62 for a predetermined period of time TG to rotate the feed roller 23, the developing roller 24, and the register rollers 106. The predetermined period of time TG is set to an arbitrary value (e.g., 3 sec or more) including a minimum of a period of time required for the developing roller 24 to rotate once. The period of time TG is a warm-up period of the developing device 13 and aims especially at keeping the toner carried by the developing roller 24 stably charged. When the period of time TG elapses after the timing T4, the CPU 71 stops the operation of the developing/register rollers driver 62 to stop rotation of the feed roller 23, the developing roller 24, and the register rollers 106 (a timing T5 in FIG. 5).

The paper feed mechanism section 104 starts conveyance of the printing sheet P at a predetermined timing based on the print start signal. The printing sheet P conveyed by the paper feed mechanism section 104 is stopped when its leading end is abutted against the register rollers 106. At this time, any skew of the printing sheet P is corrected, and the posture of the printing sheet P is adjusted.

Preparation of the respective portions is completed by the above operations, and an image printing operation is enabled.

While the printing sheet P is conveyed by the paper feed mechanism section 104, when the printing sheet P reaches the registration sensor 107, the registration sensor 107 detects the printing sheet P. An output from the registration sensor 107 is supplied to the facsimile main control circuit. The facsimile main control circuit outputs a print start signal when a predetermined time elapses after the registration sensor 107 detects the printing sheet P.

Upon reception of the print start signal from the facsimile main control circuit (a timing T6 in FIG. 5), the CPU 71 causes the exposure device 101 to start an exposure operation after a short time (a timing T7 in FIG. 5). Also, when a predetermined period of time TH elapses after the timing T6, the CPU 71 causes the developing/register rollers driver 62 to start operation, thereby starting rotation of the feed roller 23, the developing roller 24, and the register rollers 106 (a timing T8 in FIG. 5). The predetermined period of time TH is determined by an equation:

TH

=(a period of time required for the printing sheet P to move from the registration sensor 107 to the register rollers 106)

+(a period of time required for registering a printing sheet by the register rollers 106)

−(a time after the registration sensor 107 is turned on and until a print start signal is output)

Note that the period of time required for registering a printing sheet by the register rollers 106 is a period of time required after a printing sheet P is abutted against the register rollers 106 for the first time and until correction of its skew (aligning) is completed.

In this embodiment, the register rollers 106 are arranged such that the distance from the register rollers 106 to the transfer position on the convey path of the printing sheet P is longer than the distance from the developing position to the transfer position on the moving track of the surface of the photosensitive drum 11.

The reason for the above positional relationship is as follows. At the transfer position, the leading end of the toner image on the photosensitive drum 11 and that of the printing sheet P must substantially coincide. In this embodiment, since the distance from the register rollers 106 to the transfer position on the convey path of the printing sheet P is longer than the distance from the developing position to the transfer position on the moving track of the surface of the photosensitive drum 11, as described above, rotation of the register rollers 106 is started before the leading end of the electrostatic latent image reaches the developing position in order to satisfy the above conditions. Accordingly, when the electrostatic latent image reaches the developing position and the developing operation should be started by the developing device 13, since aligning has already been completed, rotation of the register rollers 106 need not be stopped by stopping the developing/register rollers driver 62. Therefore, rotation of the developing roller 24 which is caused by the developing/register rollers driver 62 is not stopped during the developing operation.

If rotation of the developing roller 24 is stopped during the developing operation, toner supply to the surface of the photosensitive drum 11 becomes non-stable to possibly degrade the image quality. However, according to this embodiment, since rotation of the developing roller 24 is not stopped during the developing operation, high-quality image printing can be performed.

Thereafter, a printing operation is performed in the following manner. The surface (photosensitive surface) of the photosensitive drum 11 is charged to a predetermined potential (e.g., −600 V) by the charging device 12, and exposed by the exposure device 101 in accordance with an image to be printed, thereby forming an electrostatic latent image. The electrostatic latent image formed on the photosensitive surface of the photosensitive drum 11 is developed by the developing device 13.

In the developing device 13, the toner supplied from the toner hopper 21 mainly by the feed roller 23 is carried by the developing roller 24 and conveyed to be brought into contact with the surface of the photosensitive drum 11. When the toner carried by the developing roller 24 is conveyed, it is regulated to a thin layer by the developing blade 25 and charged by friction to have the same polarity (negative) as that of the charge potential of the photosensitive drum 11.

Since a developing bias (e.g., −200 V) is applied from the developing bias power supply 31 to the developing roller 24, the toner selectively attaches to the photosensitive drum 11 by the function of the electric field produced in accordance with the electrostatic latent image, the developing bias, and the charge of the toner. More specifically, the toner does not attach to the non-exposed portion of the photosensitive drum 11 since the potential of the non-exposed portion of the photosensitive drum 11 is higher, and the toner attaches to the exposed and discharged portion of the photosensitive drum 11 since the potential of the exposed and discharged portion of the photosensitive drum 11 is lower. In this manner, a toner image corresponding to the electrostatic latent image is formed on the surface of the photosensitive drum 11. This toner image is transferred to the printing sheet p by the transfer device 102.

In the transfer device 102, a positive transfer voltage (e.g., +1,350 V) is applied to the transfer roller 51 to inject charges to the rear surface of the printing sheet P. Since the charges injected to the rear surface of the printing sheet P are positive, the negatively charged toner is attracted by the printing sheet P. Then, the toner image formed on the surface of the photosensitive drum 11 is transferred to the printing sheet P.

Then, after the printing sheet P is separated from the photosensitive surface of the photosensitive drum 11, the toner which is not transferred and remains on the surface of the photosensitive drum 11 is removed by the cleaning device 14.

A predetermined period of time TI after the timing T8, the CPU 71 stops the operation of the developing/register rollers driver 62 to stop rotation of the feed roller 23, the developing roller 24, and the register rollers 106 (a timing T9 in FIG. 5). The predetermined period of time TI is determined in accordance with:

$$TI=(PS+f-L)/v+1.0$$

where PS is the length of the printing sheet, f is the distance from the register rollers 106 to the transfer position on the convey path of the printing sheet P, L is the distance from the developing position to the transfer position on the moving track of the photosensitive drum 11, and v is the convey speed of the printing sheet P. More specifically, if the printing sheet size is A4, TI is, e.g., 11.73 sec; if the printing sheet size is B4, TI is, e.g., 13.15 sec.

Thereafter, if the following page need be printed, the CPU 71 controls the respective portions of the apparatus at the same timings as those described above in synchronism with a print start signal.

When printing of the last page in one printing operation is completed, a predetermined period of time TJ after a timing (a timing T10 in FIG. 5) at which the exposure operation of a corresponding image is completed, the CPU 71 stops the operation of the developing/register rollers driver 62 to stop rotation of the feed roller 23, the developing roller 24, and the register rollers 106 (a timing T11 in FIG. 5). The predetermined period of time TJ is set to an arbitrary value including a minimum of a time (e.g., 2.4 sec) required for an arbitrary point on the surface of the photosensitive drum 11 to move from the developing position to the transfer position.

Furthermore, a predetermined period of time TK after the timing T11, the CPU 71 switches the switch 54 to be connected to the roller cleaning power supply 53, thereby switching the voltage to be applied to the transfer roller 51 to a negative roller cleaning voltage (a timing T12 in FIG. 5). The predetermined period of time TK is set to be shorter than a period of time required for a portion of the photosensitive drum which was located at the developing position at the timing T11 at which rotation of the developing roller 24 was stopped, to reach the transfer position.

In this manner, when a portion of the developing roller 24, that has passed the developing position after rotation of the developing roller 24 was stopped, passes the transfer position, the negative roller cleaning voltage is applied to the transfer roller 51. A portion of the surface of the photosensitive drum 11, that has passed the developing position after rotation of the developing roller 24 was stopped, rubs against the toner attaching to the developing roller 24. Therefore, the toner attaches to the photosensitive drum 11 due to a mechanical force. However, this toner is a normally charged toner; it is negatively charged. Therefore, when the toner passes the transfer position, it is repelled due to the negative roller cleaning voltage, and will not attach to the transfer roller 51.

Then, a predetermined period of time TL after the timing T12, the CPU 71 stops the operation of the main driver 61 to stop rotation of the photosensitive drum 11 and the transfer roller 51 and the charging operation of the charging device 12 (a period of time point T13 in FIG. 5).

Simultaneously, the CPU 71 turns off the switches 33, 32, and 54 to respectively stop application of the feed bias to the feed roller 23, the developing bias to the developing roller 24, and the voltage to the transfer roller 51. Then, the apparatus returns to the standby state.

After the CPU 71 switches the switch 54 to be connected to the transfer power supply 52 at the timing T2, it fixes the switch 54 at the transfer power supply 52 side until the timing T12, i.e., until all the pages in one printing operation are printed.

After the toner is replenished, the pressure applied to the toner located between the developing roller 24 and the developing blade 25 is increased. Then, the toner easily moves between the developing roller 24 and the developing blade 25, and part of the toner not sufficiently charged by friction with the developing blade 25 is brought into contact with the photosensitive drum 11. Such toner has a small amount of the negative charge and has a large amount of the positive charge inversely. Therefore, a large amount of positively charged toner attaches to the photosensitive drum 11 (fogging occurs).

In this embodiment, however, since a positive transfer voltage is always applied to the transfer roller 51 during the time T2 to T12, the positively charged toner attaching to the photosensitive drum 11, in the manner as described above, is repelled due to the positive transfer voltage and is prevented from attaching to the transfer roller 51.

The printing sequence has been described so far. When the printing sequence of step ST7 (FIG. 4) ends, the CPU 71 recognizes the time when the apparatus has shifted from the printing state to the standby state by referring to the time indicated by the timer circuit 64, and stores this time in the RAM 73 as the standby start time. This standby start time is utilized in calculation (step ST4) of a waiting time required when a subsequent printing operation is started.

In the standby state, when the upper body 3 is opened to allow maintenance and then closed, the CPU 71 determines that the upper body 3 is closed from the open state in step ST2 based on the output from the cover open/close sensor 108, and the flow advances to step ST9. In step ST9, the CPU 71 executes a transfer roller cleaning sequence.

The transfer roller cleaning sequence will be described in detail with reference to the timing chart of FIG. 11.

Figure 11:
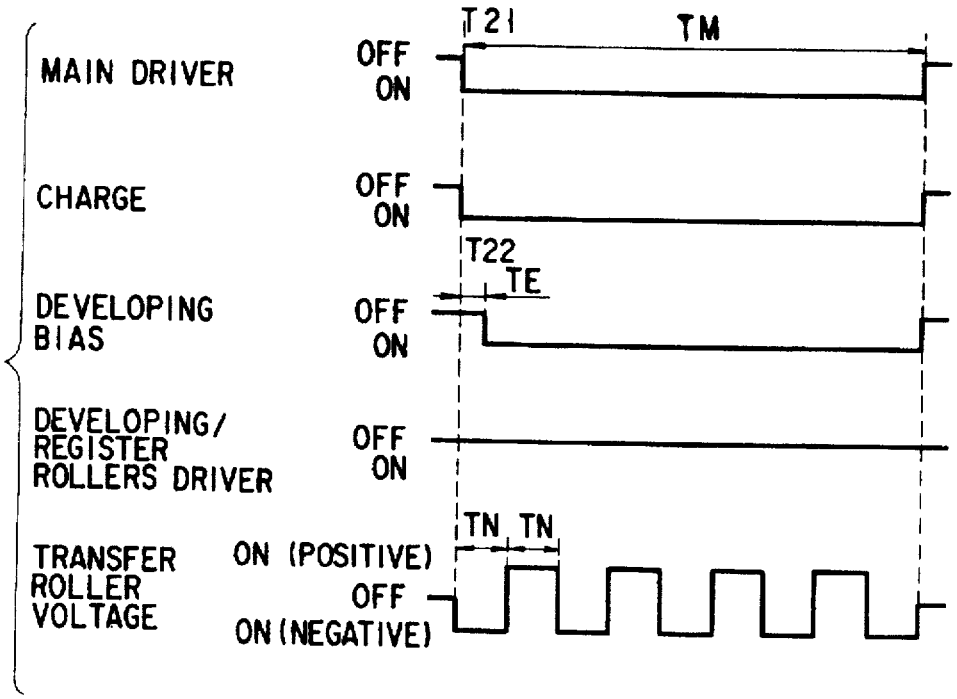
FIG. 11 is a timing chart showing a transfer roller cleaning sequence.

The CPU 71 causes the main driver 61 to start operation to rotate the photosensitive drum 11 and the transfer roller 51 and causes the charging device 12 to start the charging operation (a timing T21 in FIG. 11). Also, a period of time TE after the timing T21 (a timing T22 in FIG. 11), the CPU 71 turns on the switches 32 and 33 to start application of the feed bias to the feed roller 23 and application of the developing bias to the developing roller 24.

Thereafter, until a predetermined period of time TM lapses (a timing T23 in FIG. 11) after the timing T21, the CPU 71 continuously rotates the photosensitive drum 11 and the transfer roller 51 by the main driver 61, causes the charging device 12 to perform the charging operation, and applies the feed bias to the feed roller 23 and the developing bias to the developing roller 24. In this period, the CPU 71 does not cause the developing/register rollers driver 62 to operate so that rotation of the feed roller 23, the developing roller 24, and the register rollers 106 is kept stopped.

In the predetermined period of time TM in the state as described above, the CPU 71 repeatedly switches the switch 54 between the transfer power supply 52 side and the roller cleaning power supply 53 side at a cycle of a predetermined period of time TN. The predetermined period of time TM is set to an arbitrary value including a minimum of a time required for the transfer roller 51 to rotate once.

The upper body 3 is opened when elimination of a jam of a printing sheet P is performed, the toner is replenished to the toner hopper 21 (a new toner pack 22 is mounted), the process unit 100 is replaced, and so on. Before and after the occurrence of a jam, toner replenishment, or replacement of the process unit 100, a large amount of toner attaches to the photosensitive drum 11, and the toner is thus attached to the transfer roller 51. The charge polarity of the toner attaching to the transfer roller 51 at this time is not fixed, but the toner is partly negatively charged and partly positively charged in a mixed manner.

However, when the upper body 3 is closed, i.e., when each of the operations described above is ended, the transfer roller cleaning sequence as described above is executed. More specifically, while the surface of the photosensitive drum 11 is uniformly charged, a positive transfer voltage and a negative roller cleaning voltage are alternately applied to the transfer roller 51, as shown in FIG. 11. Accordingly, when the positive transfer voltage is applied to the transfer roller 51, it repels the positively charged toner which then returns to the surface of the photosensitive drum 11. When the negative roller cleaning voltage is applied to the transfer roller 51, it repels the negatively charged toner which returns to the surface of the photosensitive drum 11. The transfer roller 51 is cleaned in this manner. Thereafter, if a normal printing operation is to be performed, the rear surface of the printing sheet P is prevented from being soiled.

In this embodiment, since the cycle TN during which the transfer or roller cleaning voltage is applied is set to be longer than the time required for the transfer roller 51 to rotate once, the toner can be reliably removed from throughout the entire circumferential surface of the transfer roller 51. The period of time TM during which the transfer roller cleaning sequence is executed is arbitrarily set to a time (e.g., about 30 to 60 sec) allowing sufficient cleaning of the transfer roller 51.

The transfer roller cleaning sequence has been described so far. When the CPU 71 ends the transfer roller cleaning sequence of step ST9, the apparatus is returned to the standby state.

In the standby state, when the CPU 71 recognizes in step ST3 that a predetermined night mode start time has reached based on a time indicated by the timer circuit 64, the apparatus is shifted to the night mode. In the night mode, the respective power supplies of the apparatus excluding some (e.g., the control circuit 63 and the timer circuit 64) are kept OFF in a time zone having a less communication frequency in order to decrease power consumption.

Figure 12:
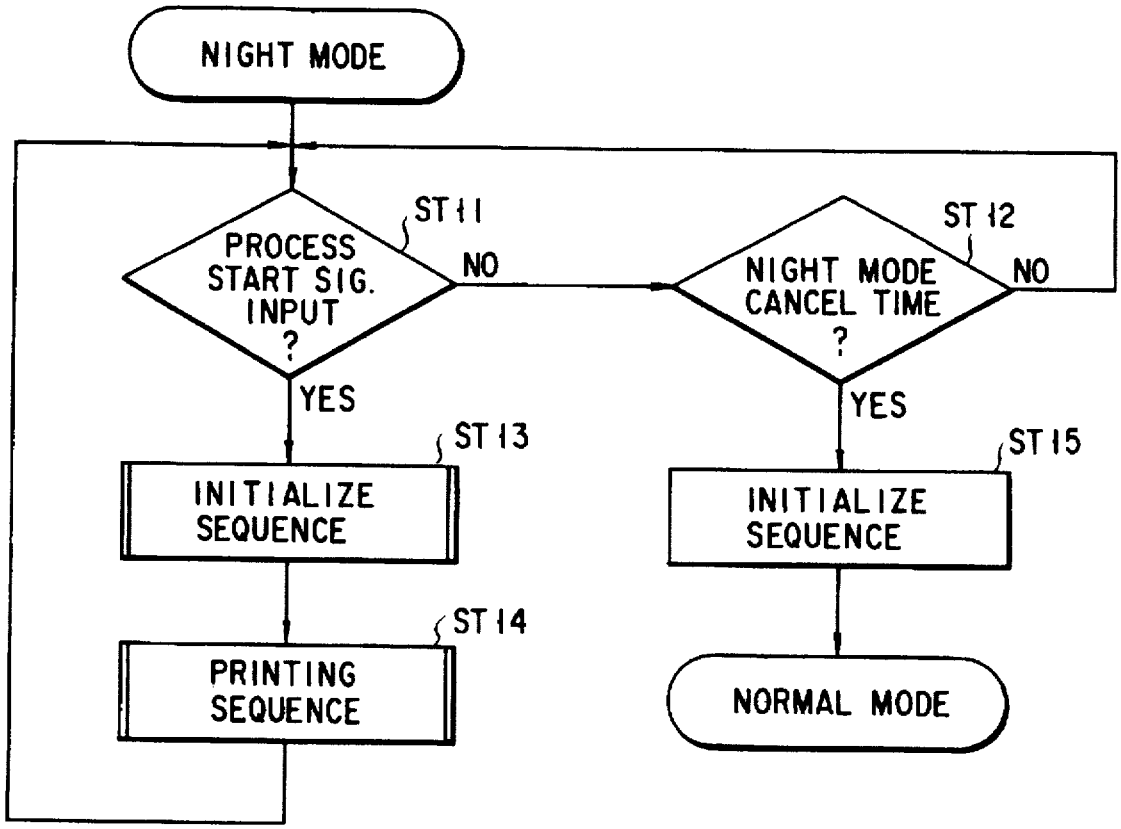
FIG. 12 is a flow chart showing the processing procedure of the CPU in a night mode.

In the night mode, as shown in FIG. 12, the CPU 71 repeatedly performs in the standby state a determination (step ST11) as to whether or not a process start signal is input and a determination (step ST12) as to whether or not the present time is the time to cancel the night mode.

In this standby state, if a process start signal is supplied from the facsimile main control circuit and accepted by the I/O port 74, the CPU 71 determines in step ST11 that a process start signal has arrived, and the flow advances to step ST13. The CPU 71 executes an initialize sequence (step ST13) prior to the printing sequence (step ST14).

In the standby state, if the CPU 71 recognizes that the predetermined night mode cancel time has reached in step ST12 based on the time indicated by the timer circuit 64, the CPU 71 performs the initialize sequence (step ST15) prior to shifting to the normal mode.

Furthermore, in a shift from the standby state to the operation state in the normal mode, if the CPU 71 determines in step ST5 of FIG. 4 that the waiting time is equal to a predetermined time or longer, it executes the initialize sequence (step ST6 in FIG. 4) prior to the printing sequence of step ST7 in FIG. 4.

The initialize sequence will be described in detail with reference to the timing chart of FIG. 13.

Figure 13:
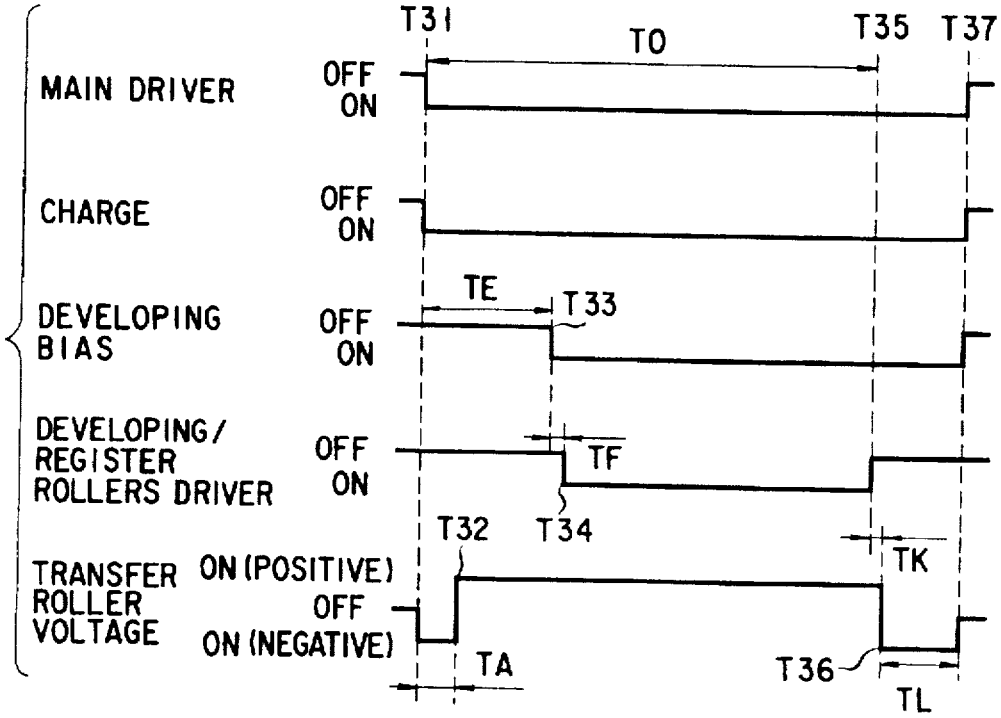
FIG. 13 is a timing chart showing an initialize sequence.

The CPU 71 causes the main driver 61 to start operation to rotate the photosensitive drum 11 and the transfer roller 51, and causes the charging device 12 to start the charging operation (a timing T31 in FIG. 13). At the timing T31, the CPU 71 switches the switch 54 to be connected to the roller cleaning power supply 53. Then, a negative roller cleaning voltage generated by the roller cleaning power supply 53 is applied to the transfer roller 51.

Subsequently, a period of time TA after the timing T31 (a timing T32 in FIG. 13), the CPU 71 switches the switch 54 to be connected to the transfer power supply 52. Furthermore, a period of time TE after the timing T31 (a timing T33 in FIG. 13), the CPU 71 turns on the switches 32 and 33 to start application of the feed bias to the feed roller 23 and of the developing bias to the developing roller 24. A short period of time TF after the timing T33, the CPU 71 starts the developing/register rollers driver 62 to rotate the feed roller 23, the developing roller 24, and the register rollers 106 (a timing T34 in FIG. 13).

Thereafter, a predetermined period of time TO after the timing T31 (a timing T35 in FIG. 13), the CPU 71 ends the operation of the developing/register rollers driver 62 to stop rotation of the feed roller 23, developing roller 24, and the register rollers 106. The predetermined period of time TO is set to a time during which the developing roller 24 can be rotated to a certain degree at least once, which is, e.g., a time required for the temperature of the heat roller incorporated in the fixing device 103 to reach a predetermined temperature, or a time (e.g., 10 to 90 sec) arbitrarily set in the timer.

Upon a lapse of a predetermined period of time TK after the timing T35, the CPU 71 switches the switch 54 to be connected to the roller cleaning power supply 53, in order to switch the voltage to be applied to the transfer roller 51 to a negative roller cleaning voltage (a timing T36 in FIG. 13.)

A predetermined period of time TL after the timing T36, the CPU 71 stops the operation of the main driver 61 to stop rotation of the photosensitive drum 11 and the transfer roller 51, and the charging operation of the charging device 12 (a timing T37 in FIG. 13). Simultaneously, the CPU 71 turns off the switches 32, 33, and 54 to stop application of the feed bias to the feed roller 23, the developing bias to the developing roller 24, and the voltage to the transfer roller 51.

The initialize sequence has been described so far. After ending this initialize sequence, the CPU 71 performs the printing sequence in step ST7 of FIG. 4 or step ST14 of FIG. 12, or shifts to the normal mode.

When the operation has been stopped for a long period of time, an amount of the charge of the toner is decreased in the developing device 13. When a developing operation is started from this state, the toner having a low amount of charge is undesirably brought into contact with the photosensitive drum 11, and a large amount of toner unnecessarily attaches to the photosensitive drum 11.

In this embodiment, however, when the operation has been stopped for a long period of time, the initialize sequence is performed prior to the printing sequence or shifting to the normal mode, in order to rotate the developing roller 24 to a certain degree. Hence, when a developing operation is to be successively performed, the toner carried by the developing roller 24 can be sufficiently charged. Accordingly, unnecessary toner attachment to the photosensitive drum 11 is decreased. In this embodiment, since the printing frequency is generally low in the night mode, the initialize sequence is performed prior to starting the printing sequence in the night mode or shifting from the night mode to the normal mode regardless of the length of the waiting time.

When the operation has been stopped for a long period of time, in the developing device 13, the developing blade 25 is constantly in contact with the same position of the developing roller 24. Since the developing blade 25 is urged by the leaf spring 27 to compress the surface of the developing roller 24, a portion of the surface of the developing roller 24 contacting the developing blade 25 is distorted. If a developing operation is performed in this state, a horizontal line is formed in a portion of an image as a result of development with the distorted developing roller 24, thus degrading the image quality.

In this embodiment, however, after the operation has been stopped for a long period of time, the initialize sequence is performed prior to the printing sequence or shifting to the normal mode, so that the developing roller 24 is rotated to a certain degree. As the developing roller 24 is mainly made of urethane or the like, as shown in FIG. 3, when it is rotated, it is restored to the original state. Distortion is thus recovered by rotation in the initialize sequence. Accordingly, when printing is to be subsequently performed in the printing sequence, a horizontal line will not be formed in the image.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, in the above embodiments, the transfer roller 51 is used as a transfer contact member. However, a component other than a roller, e.g., a brush may be used for transfer the toner image to the recording sheet. The present invention is not limited to a facsimile apparatus, and may be applied to a copying machine and a printer.

What is claimed is:

1. An electrophotographic apparatus comprising charging means and developing means which are respectively arranged at a predetermined charging position and a predetermined developing position along a surface of a photosensitive member, the photosensitive member having a predetermined point which is located at the charging position when charging of said photosensitive member by said charging means starts, said developing means including toner carrier means and carrier rotating means for rotating the toner carrier means, the apparatus further comprising:

development control means for keeping rotation of said toner carrier means by said carrier rotating means stopped from start of rotation of said photosensitive member until said predetermined point of said photosensitive member reaches the predetermined developing position.

2. An electrophotographic apparatus according to claim 1, in which said development control means further comprises:

means for causing said carrier rotating means to rotate said toner carrier means after said predetermined point of said photosensitive member reaches the predetermined developing position; and means for applying a developing bias to said toner carrier means after said predetermined point of said photosensitive member reaches the predetermined developing position.

3. An electrophotographic apparatus including charging means arranged at a predetermined charging position along a surface of a photosensitive member and developing means arranged at a predetermined developing position along the surface of the photosensitive member, the developing means including toner carrier means contacting the photosensitive member and carrier rotating means for rotating the toner carrier means, toner being charged to have a predetermined polarity by rotation of the toner carrier means, the photosensitive member having a predetermined point located at the developing position when the photosensitive member starts rotating, the apparatus comprising:

first power supply means for generating a voltage having an opposite polarity to the predetermined polarity;

a contact member arranged at a predetermined transfer position for applying the voltage generated by said first power supply means to a printing sheet disposed at said photosensitive member;

second power supply means for generating a voltage having the predetermined polarity;

switching means having at least a first state, in which the voltage generated by said first power supply means is applied to said contact member, and a second state, in which the voltage generated by said second power supply means is applied to said contact member; and control means for setting said switching means to the second state upon start of rotation of the photosensitive member and maintaining the switching means in the second state until said predetermined point on said photosensitive member passes the transfer position.

4. An electrophotographic apparatus comprising:

developing means, arranged at a predetermined developing position, for forming a toner image on a photosensitive member;

transfer means, arranged at a predetermined transfer position, for transferring, to a printing sheet, the toner image formed on said photosensitive member;

aligning means for adjusting a posture of the printing sheet to be conveyed to the transfer position to a predetermined state, said aligning means being arranged at a predetermined position such that a distance of a convey path of the printing sheet from said aligning means to the transfer position is longer than a distance of a moving track of a surface of said photosensitive member from the developing position to the transfer position; and means for driving both the aligning means and the developing means.

5. An electrophotographic apparatus which is shifted from a normal mode to a predetermined standby mode if a printing instruction is not received for a predetermined period of time, the apparatus comprising:

developing means, arranged at a predetermined developing position, for forming a toner image on a photosensitive member which is charged to have a predetermined polarity;

transfer means for transferring the toner image formed on said photosensitive member to a printing sheet, the transfer means including a contact member arranged to contact a printing sheet arranged to contact said photosensitive member, first voltage generating means for generating a first voltage having an opposite polarity to the predetermined polarity, second voltage generating means for generating a predetermined second voltage having the predetermined polarity, and switching means having at least a first state, in which the first voltage is applied to said contact member, and a second state, in which the second voltage is applied to said contact member; and control means for setting said switching means to the first state when said apparatus is shifted from the standby mode to the normal mode, the control means further comprising means for maintaining the switching means in the first state while the apparatus is in the normal mode.

6. An electrophotographic apparatus having an openable/closable apparatus cover, the apparatus comprising:

developing means for forming a toner image on a surface of a photosensitive member which is charged to have a predetermined polarity, the developing means including toner carrier means, carrier rotating means for rotating the toner carrier means, developing bias power supply means for generating a developing bias to be applied to said toner carrier means, and developing switching means for turning on/off application of the developing bias to said toner carrier means;

transfer means for transferring the toner image formed on said surface of said photosensitive member to a printing sheet, the transfer means including a contact member arranged to contact a printing sheet arranged to contact said photosensitive member, first voltage generating means for generating a first voltage having an opposite polarity to the predetermined polarity, second voltage generating means for generating a second voltage having the predetermined polarity, and switching means having at least a first state, in which the first voltage is applied to said contact member, and a second state, in which the second voltage is applied to said contact member;

detecting means for detecting that said apparatus cover is closed from an open state; and control means for setting, when said detecting means detects that said apparatus cover is closed from the open state, said switching means to the first and second states at least once in a state wherein said photosensitive member is charged, said developing switching means is turned on to apply the developing bias to said toner carrier means, and rotation of said toner carrier means by said carrier rotating means is stopped.

7. An electrophotographic apparatus having a low-power mode, in which power supplies to some sections are decreased relative to power supplies in modes other than the low-power mode, comprising;

developing means for forming a toner image on a photosensitive member, the developing means including toner carrier means and carrier rotating means for rotating said toner carrier means; and control means for causing said carrier rotating means to rotate said toner carrier means by a predetermined amount before performing printing in the low-power mode.

8. An apparatus according to claim 7, further comprising:

detecting means for detecting a present time; and determining means, responsive to the detecting means, for determining whether an operation mode is the low-power mode based on whether the present time falls within a predetermined period of time designated for the low-power mode.

9. An electrophotographic apparatus having a low-power mode, in which power supplies to some sections are decreased relative to power supplies in modes other than the low-power mode, comprising:

developing means for forming a toner image on a photosensitive member, the developing means including toner carrier means and carrier rotating means for rotating said toner carrier means; and control means for causing said carrier rotating means to rotate said toner carrier means by a predetermined amount immediately after the low-power mode is canceled.

10. An apparatus according to claim 9, further comprising:

detecting means for detecting a present time; and determining means, responsive to the detecting means, for determining whether an operation mode is the low-power mode based on whether the present time falls within a predetermined period of time designated for the low-power mode.

11. An electrophotographic apparatus comprising:

developing means for forming a toner image on a photosensitive member, the developing means including a toner carrier roller made of an elastic member for carrying a toner to said photosensitive member, a developing blade contacting with the toner carrier roller for maintaining an amount of toner carried to said photosensitive member, and rotating means for rotating said toner carrier roller to charge the toner by friction with the developing blade;

measuring means for measuring a period of time during which the rotation of said toner carrier roller is stopped; and control means for causing said rotating means to rotate said toner carrier roller by a predetermined amount before starting a printing operation when the period of time measured by the measuring means exceeds a predetermined length, wherein said developing means comprises a first motor for rotating said toner carrier roller and a second motor for rotating said photosensitive member.

12. An electrophotographic apparatus comprising:

developing means for forming a toner image on a photosensitive member, the developing means including a toner carrier roller made of an elastic member for carrying a toner to said photosensitive member, a developing blade urged into contact with the toner carrier roller by a spring for maintaining an amount of toner carded to said photosensitive member, and rotating means for rotating said toner carrier roller to charge the toner by friction with the developing blade;

measuring means for measuring a period of time during which the rotation of said toner carrier roller is stopped; and control means for causing said rotating means to rotate said toner carrier roller by a predetermined amount before starting a printing operation when the period of time measured by the measuring means exceeds a predetermined length.

* * * * *